US008691561B2

(12) United States Patent
Igata

(10) Patent No.: US 8,691,561 B2
(45) Date of Patent: Apr. 8, 2014

(54) THERMAL TREATMENT APPARATUS AND FLUID TREATMENT METHOD WITH FLUIDIC DEVICE

(75) Inventor: Eishi Igata, Utsunomiya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/470,021

(22) Filed: May 11, 2012

(65) Prior Publication Data

US 2012/0295341 A1 Nov. 22, 2012

(30) Foreign Application Priority Data

May 16, 2011 (JP) ..... 2011-109450

(51) Int. Cl.
*C12M 1/34* (2006.01)
*C12M 3/00* (2006.01)

(52) U.S. Cl.
USPC ..... 435/287.2; 435/3; 435/286.5

(58) Field of Classification Search
USPC ..... 435/3, 286.5, 287.2
See application file for complete search history.

(56) References Cited

U.S. PATENT DOCUMENTS

| | | | | |
|---|---|---|---|---|
| 6,750,661 | B2 * | 6/2004 | Brooks et al. | 324/693 |
| 2008/0003649 | A1 * | 1/2008 | Maltezos et al. | 435/91.2 |
| 2012/0058460 | A1 * | 3/2012 | Coursey et al. | 435/3 |

FOREIGN PATENT DOCUMENTS

| | | | |
|---|---|---|---|
| JP | 2008-128906 | A | 6/2008 |
| JP | 2008-151772 | A | 7/2008 |

* cited by examiner

*Primary Examiner* — Michael Marcheschi
*Assistant Examiner* — Timothy Barlow
(74) *Attorney, Agent, or Firm* — Canon U.S.A., Inc., IP Division

(57) ABSTRACT

A thermal treatment apparatus includes a fluidic device including at least one channel, a first temperature-changing unit that changes the temperature of a fluid in part of the channel, and a second temperature-changing unit that changes the temperature of the fluid in another part of the channel. The temperature changes by the first and second temperature-changing units cause at least any one of the expansion and contraction of the fluid in the respective parts of the channel, and the at least any one of the expansion and contraction of the fluid due to the first temperature-changing unit is offset by the at least any one of the expansion and contraction of the fluid due to the second temperature-changing unit.

8 Claims, 4 Drawing Sheets

THERMAL TREATMENT APPARATUS AND FLUID TREATMENT METHOD WITH FLUIDIC DEVICE

BACKGROUND OF THE INVENTION

1. Field of the Invention

The present invention relates to a thermal treatment apparatus and a method for treating a fluid, the apparatus and method involving a fluidic device having a channel. In particular, the present invention relates to a method for regulating the transfer of a fluid in the channel during application of a temperature cycle.

2. Description of the Related Art

In analytical chemistry, desired data on, for example, concentration and components are generally obtained for confirmation of the progress and results of chemical and biochemical reactions, and various apparatuses and sensors have been therefore developed to obtain such data. Such apparatuses and sensors are formed in a reduced size by using a precision machining method and semiconductor-manufacturing equipment, and a technique called a micro total analysis system (μ-TAS) or a lab-on-a-chip has been developed. All processes for obtaining the desired data are performed on a micro device. In this technique, a collected unpurified specimen or a raw material is made to pass through a channel or micro space formed in a micro device to undergo, for instance, specimen purification or chemical reaction, thereby obtaining data on the concentration of a component contained in the final specimen or obtaining a chemical compound. These micro devices for such an analysis and reaction treat a minute amount of solution and gas and are thus often called a micro-fluidic device.

Use of the micro-fluidic device enables an amount of a fluid contained in the micro-fluidic device to be reduced as compared with existing desktop-size analytical equipment. It is therefore expected that the necessary amount of a reagent is decreased and that reaction time is reduced by virtue of decrease in the amount of an object to be analyzed. Technology associated with the μ-TAS has been developed with increasing appreciation of the advantages of the fluidic device.

However, the downsizing of the desktop-size equipment to the micro device generates new technical issues. For instance, a fluid confined in a micro channel becomes more sensitive to changes in environment. In particular, heat applied to the micro channel causes a fluid to be thermally expanded or evaporated, and these problems should be considered.

In the desktop-size equipment, since a micro tube or a well plate is used, a fluid content is thermally expanded in a substantially ignorable degree. In the micro channel, the fluid may be thermally expanded or evaporated to an undesirable degree. In order to suppress the transfer of a fluid, Japanese Patent Laid-Open No. 2008-151772 discloses a method in which heat is applied at a certain temperature to a micro channel that is in communication with a reaction field. By virtue of this method, even though a solution in the reaction field is partially evaporated with the result that the transfer of the solution is caused, the solution remains in a measurement region.

In addition to a method using the temperature adjustment, methods using a micro valve and a magnetic fluid have been proposed to suppress the transfer of a fluid. Furthermore, another method has been also proposed, in which the position of a solution in the channel is detected by taking an image and in which pressure from a pump that is in communication with the channel is then regulated to make the solution stay within a certain region (see Japanese Patent Laid-Open No. 2008-128906).

Although various techniques have been proposed to control a position of the fluid in the channel as described above, each technique has potential issues.

In particular, the device in which the micro valve is provided inside the channel needs a mechanism to control the opening and closing of the valve.

Furthermore, the method in which the magnetic fluid is put into the channel needs a mechanism to locally generate a magnetic field and is limited to the application in which the magnetic field does not prevent a reaction.

The technique which involves detecting the position of a fluid in an image and then regulating the pressure from a pump that is in communication with the channel increases the overall system cost. In addition, the accuracy of the position of the fluid depends on a feedback speed of the whole system.

SUMMARY OF THE INVENTION

An aspect of the present invention provides an apparatus that enables thermal treatment by using a fluidic device having a channel without use of an expensive unit for correcting a position of a fluid and provides a method for regulating the transfer of a fluid in the fluidic device.

According to an aspect of the invention, a thermal treatment apparatus is provided, the apparatus including a fluidic device having at least one channel, a first temperature-changing unit configured to change the temperature of a fluid in at least a first part of the at least one channel, and a second temperature-changing unit configured to change the temperature of the fluid in at least a second part of the at least one channel, wherein the temperature changes by the first and second temperature-changing units cause at least any one of an expansion and contraction of the fluid in parts of the channel that are affected by the temperature changes, and the at least any one of the expansion and contraction of the fluid due to the temperature change caused by the first temperature-changing unit is offset by the at least any one of the expansion and contraction of the fluid due to temperature change caused by the second temperature-changing unit.

By virtue of the embodiments of the invention, while the first temperature-changing unit changing the temperature of a fluid results in the fluid expanding or contacting, the second temperature-changing unit offsets the expansion or contraction. The transfer of the fluid in the channel due to the temperature change can be therefore substantially restricted.

In other words, a chemical or biochemical reaction which needs temperature change can be conducted without the transfer of a fluid in a detection region.

In addition, a simple configuration including the two temperature-changing units can be provided, and a system and method using the advantageous fluidic device can be provided without an expensive apparatus configuration.

Further features of the present invention will become apparent from the following description of exemplary embodiments with reference to the attached drawings.

DESCRIPTION OF THE EMBODIMENTS

Figure 1:
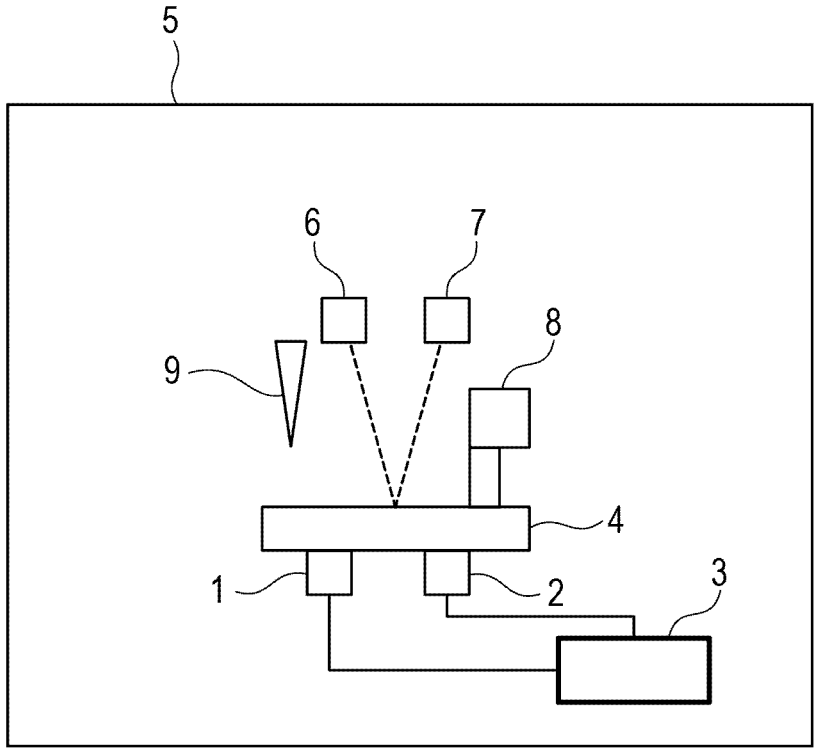
FIG. 1 schematically illustrates an analysis apparatus in accordance with an embodiment of the invention.

FIG. 1 schematically illustrates a thermal treatment apparatus in accordance with an exemplary embodiment of the invention.

A thermal treatment apparatus 5 includes a fluidic device 4 and first and second temperature-changing units 1 and 2 that change the temperature of respective parts of the channel of the fluidic device 4.

The first temperature-changing unit 1 changes temperature to expand or contract a fluid in part of the channel, and the second temperature-changing unit 2 changes temperature to expand or contract the fluid in another part of the channel with the result that the expansion or contraction of the fluid, which is brought by the first temperature-changing unit 1, is offset.

The first and second temperature-changing units 1 and 2 are individually connected to an instruction unit 3 (temperature controller) that gives the first and second temperature-changing units 1 and 2 an instruction in which the first temperature-changing unit 1 changes the temperature of a fluid in a first temperature-changing region in the manner opposite to the second temperature-changing unit 2 that changes the temperature of the fluid in a second temperature-changing region.

The instruction unit 3 provides the first and second temperature-changing units 1 and 2 with an instruction in which the rate of temperature increase by the first temperature-changing unit 1 is equal to the rate of temperature decrease by the second temperature-changing unit 2 or the rate of temperature decrease by the first temperature-changing unit 1 is equal to the rate of temperature increase by the second temperature-changing unit 2.

In this case, the rate of the temperature decrease may not need to be equal to the rate of the temperature increase as long as an analysis is not affected by the difference between the two rates.

The parts of the channel can be respectively heated by the first and second temperature-changing units 1 and 2 within one region in which a polymerase chain reaction (PCR) is conducted.

The first and second temperature-changing units 1 and 2 may be a Peltier device or a cooler that externally cools a resistive heating element and fluidic device which are located in the channel.

The thermal treatment apparatus 5, which can serve as an analysis apparatus, can include a light emitting portion 6, such as a laser or a light-emitting diode (LED), which emits light to the channel and include an emission detector 7, such as a charge coupled device (CCD) sensor, which detects light emission from the channel.

The thermal treatment apparatus 5 includes a pressure generator 8 that provides a fluid in the channel of the fluidic device 4, where the pressure generator 8 generates positive or negative pressure. The pressure generator can be implemented by a pump, such as a syringe pump, and is connected to a discharging hole of the fluidic device 4 to generate a pressure inside the channel. While the pressure generator can be a pump, any mechanism that would enable practice of the present embodiment is applicable. A liquid-introducing portion 9, such as a pipette, is also included in the thermal treatment apparatus 5.

The instruction unit (temperature controller) 3 transmits driving signals to the first and second temperature-changing units 1 and 2 and then controls the heating or cooling by the first and second temperature-changing units 1 and 2. The instruction unit 3 is connected to a power source (not illustrated). The instruction unit 3 may be a computer having a central processing unit (CPU) or may be configured as a control section which controls all of the other sections in the thermal treatment apparatus 5.

A placement portion (not illustrated) on which a member 23 is mounted may be provided, and the first and second temperature-changing units 1 and 2 may be provided on the placement portion.

In the case where a resistive heating element provided in the channel is used as the temperature-changing unit, a measurement portion can be provided, which calculates an electric resistance from a current and voltage applied to the resistive heating element to measure the temperature of a fluid in the channel.

Figure 2:
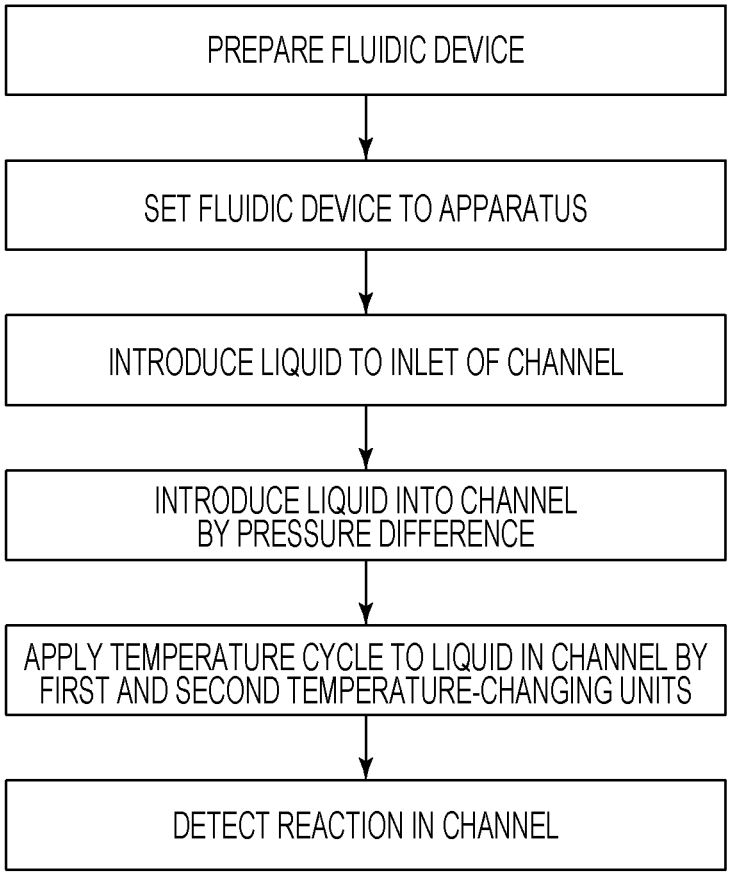
FIG. 2 is a flowchart illustrating a treatment method in accordance with an embodiment of the invention.

FIG. 2 is a flowchart illustrating an analysis process using the analysis apparatus.

The fluidic device 4 is first prepared. The fluidic device 4 is then placed in the placement portion of the thermal treatment apparatus 5. The liquid-introducing portion 9 introduces a liquid, such as a reagent, to the inlet of the channel of the fluidic device 4 (a feeding opening is provided in general). The pressure generator 8 then generates pressure difference in the channel, thereby introducing the liquid into the channel. The instruction unit 3 supplies electric power to the first and second temperature-changing units 1 and 2, thereby controlling the temperature of the liquid introduced into the channel. Examples of the temperature control include application of a temperature cycle for a PCR and temperature increase for the measurement of thermal melting. In conjunction with or after the temperature control, the reaction inside the channel is detected by the light emitting portion 6 and emission detector 7. From the results of the detection, absence or presence or degree of the reaction is determined, thereby providing an analysis of the reaction inside the channel.

In the treatment method of the present embodiment, temperature is increased in part of the channel, and temperature is decreased in another part of the channel, thereby restricting the transfer of a fluid in the channel. The rate of the temperature increase in the part of the channel can be equal to the rate of the temperature decrease in another part of the channel.

The fluidic device can be applied to a medical examination device for medical examination or diagnosis. The medical examination device is typified by a μ-TAS and collectively refers to devices used for medical examination or diagnosis, such as a DNA chip, lab-on-a-chip, microarray, and protein chip.

The fluidic device has regions which are connected to each other via a micro channel and are heated and cooled.

The thermal treatment apparatus 5, which includes the fluidic device 4 as illustrated in FIG. 1, includes at least the first and second temperature-changing units 1, 2. In the fluidic device, the first and second temperature-changing units 1, 2 individually change temperature in an opposite phase so that the expansion or contraction of a fluid due to temperature change by the first and second temperature-changing units 1, 2 offset each other.

The temperature change in an opposite phase refers to the case in which temperature change with time has an inclination in an opposite direction. For example, a case where the first temperature-changing unit 1 increases temperature and the second temperature-changing unit 2 decreases temperature or where the first temperature-changing unit 1 decreases temperature and the second temperature-changing unit 2 increases temperature. Since the temperature is changed in the channel in this manner, the expansion of the fluid in one part is offset by the contraction of the fluid in another part. The transfer of the fluid can be therefore restricted.

Temperature may be changed for offsetting in the offsetting region, namely, a region in which the second temperature change is caused, in a degree, to restrict or to eliminate the transfer of a fluid.

In the case where each part of the channel has the same cross-sectional area, length, and flow resistance, the volume change of a fluid due to heating by the first temperature-changing unit 1 can be controlled so as to be equal to the volume change of the fluid due to cooling by the second temperature-changing unit 2, or the volume change of a fluid due to cooling by the first temperature-changing unit 1 can be controlled so as to be equal to the volume change of the fluid due to heating by the second temperature-changing unit 2.

In another embodiment, the volume change of a fluid due to heating by the second temperature-changing unit 2 is greater than the volume change of the fluid due to cooling by the first temperature-changing unit 1, or the volume change of a fluid due to cooling by the second temperature-changing unit 2 is greater than the volume change of the fluid due to heating by the first temperature-changing unit 1.

The present embodiment provides an advantage in that the transfer of a fluid, which is confined in a channel, due to the thermal expansion and contraction of the fluid can be corrected even during a reaction in which heating or cooling is required. In order to correct the transfer of a fluid, the thermal expansion and contraction of the fluid in the channel is utilized.

Except for specific substances and specific temperature ranges, many types of substances are subjected to volume expansion at a constant rate with the increase in the temperature of the environment surrounding the substances. Assuming that the volume of a fluid at a certain temperature $T_1$ is $V_1$, the volume $V_2$ of the fluid is defined by the following formula in the case of increasing the temperature to $T_2$:

$$V_2=V_1[1+\beta(T_2-T_1)]$$

In the formula, β is a coefficient of volume expansion, which indicates the percentage of the expansion. Various substances have β values inherent thereto. For instance, at 20° C., water has a value of approximately $2.1\times10^{-4}$(/K) and ethanol has a value of approximately $1.1\times10^{-3}$(/K). The relationship of $T_2<T_1$ means that cooling is conducted, and the volume of a fluid is contracted (negative expansion). In existing cases in which a fluid is used in a milliliter or liter order, the volume expansion by heating can be ignored within the temperature range from 0° C. to 100° C. However, in a micro-channel in which a fluid is used in a microliter or nanoliter order, the channel has, for example, a width of 100 μm and a depth of 20 μm, and the fluid is particularly transferred due to thermal expansion only in a direction along with the channel. Thus, the fluid may be accordingly transferred in an undesirable degree.

The material of the micro fluidic device may be determined based on the chemical resistance and optical resistance, and various types of glass and various types of polymers such as polycarbonate and acryl may be employed. In particular, polymers have recently been used in view of low production costs. However, some polymers emit fluorescence, and thus polymers may not be appropriate for fluorescence analysis.

Glass may be used in view of chemical resistance. In the case of using quartz glass for the micro fluidic device, the coefficient of the volume expansion of quartz glass is approximately $5.6\times10^{-7}$(/K). Compared with the coefficient of the volume expansion of water and ethanol, this coefficient of volume expansion is significantly small within the temperature range from 0° C. to 100° C. The coefficient of the volume expansion can be ignored in the micro fluidic device using quartz glass.

Figure 3A:
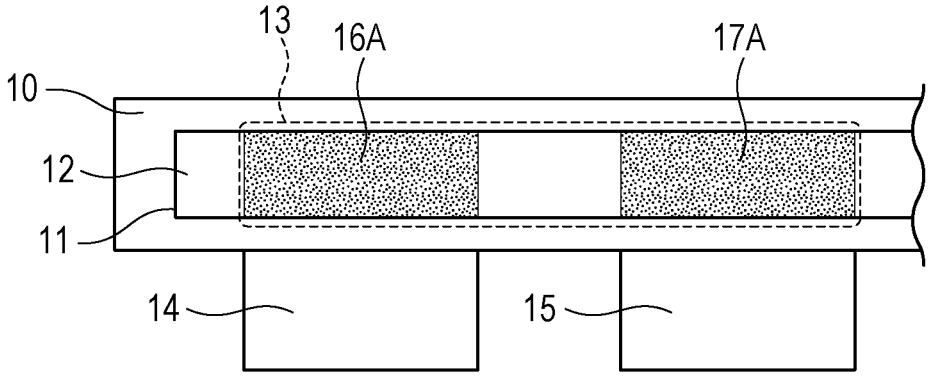
FIGS. 3A and 3B schematically illustrate an embodiment of the invention.
Figure 3B:
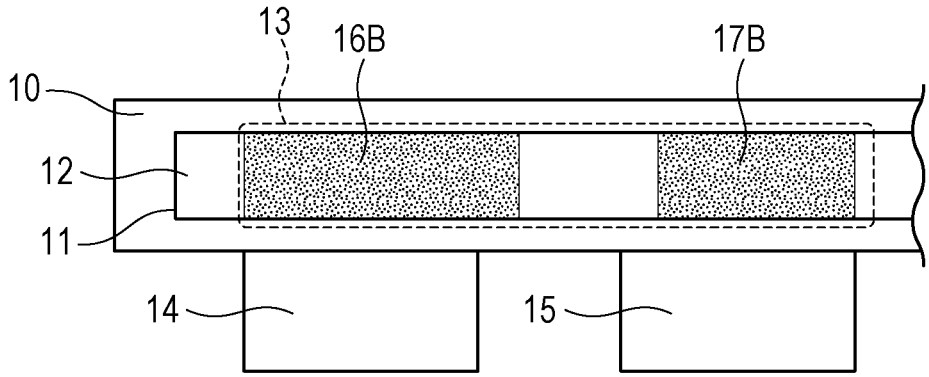

FIGS. 3A and 3B are cross-sectional views illustrating a micro fluidic device 10 having a micro channel 11 in a direction along the micro channel 11. With reference to FIG. 3A, a fluid 12 is in the micro channel 11. A reaction field 13 is provided in part of the micro channel 11 to serve as a first region, and temperature-changing units 14 and 15 are provided to individually apply thermal energy to part of the reaction field 13. The fluid 12 positioned just above the temperature-changing unit 14, in other words, the fluid within a first temperature-changing region, is defined as a fluid 16A. The fluid 12 positioned just above the temperature-changing unit 15, in other words, the fluid within a second temperature-changing region, is defined as a fluid 17A.

Any material which allows the channel to be formed in the micro fluidic device 10 can be used for the micro fluidic device 10. Examples of the material include glass materials such as quartz glass and Pyrex® glass, polymers such as acryl and polycarbonate, semiconductor materials such as silicon, and ceramics. Although the material can be determined in view of the chemical resistance of a substance to be analyzed and the suitability for detection, the material having a small coefficient of thermal expansion can be employed. The micro channel 11 may have an arbitrary configuration and is not limited to the configuration of embodiments of the invention.

The temperature-changing units 14 and 15 function to heat or cool a fluid in the micro channel 11. Various chemical or biochemical reactions are caused by application of thermal energy. A hot plate or Peltier device is typically used as a heating device and is provided to the outside of the micro fluidic device 10. Examples of a cooling device include a Peltier device, a water-cooled device which circulates water while contacting the micro fluidic device, and a device which exhausts cool air. In addition, a thin conductor is provided to the bottom or inside of the base of the micro fluidic device 10 for the heating or cooling. The heating or cooling device is not specifically limited in the invention, and an appropriate device may be selected. The distance between the temperature-changing units 14 and 15 and the distance between the micro channel 11 and each of the temperature-changing units 14 and 15 may be determined and depend on application of the micro fluidic device 10.

In the case where the fluid in the reaction field 13 is heated by the temperature-changing units 14 and 15, the fluid in the reaction field 13 overflows from the reaction field 13 because of thermal expansion. For instance, in the case where the results of a reaction conducted in the reaction field 13 are analyzed based on the fluorescent intensity, volume change needs to be considered as well as the fluorescent intensity due to temperature change.

In the cases where the temperature-changing unit 14 serves for heating with the result that the fluid 16A is subjected to volume expansion and turns to the fluid 16B illustrated in FIG. 3B and where the temperature-changing unit 15 simultaneously serves for cooling, the fluid 17A illustrated in FIG. 3A is subjected to volume contraction and turns to the fluid 17B illustrated in FIG. 3B. The expanded or contracted volume can be calculated from the coefficient of thermal expansion of the fluid, the temperature difference between before and after the temperature change, and the volume of the fluid at the time of temperature change by the temperature-changing units. The volume contraction of the fluid 17A due to the cooling by the temperature-changing unit 15 can be determined so as to be equal to the volume expansion of the fluid 16A due to the heating by the temperature-changing unit 14.

In other words, the temperature-changing units 14 and 15 change temperature in an opposite phase, so that the volume contraction by cooling can be determined so as to absorb the volume change caused by the volume expansion due to heating. The fluid which has been initially in the reaction field 13 can remain in the reaction field 13 even after the heating or cooling.

By virtue of the present embodiment, for example, in the case of capturing an image of a reaction in the channel, a camera can be placed near the channel to capture a high-resolution image.

Furthermore, since the volume of a fluid can be maintained constant in the reaction field or the micro fluidic device, the following advantages are provided: the fluid can be prevented from partially overflowing to the outside of the micro fluidic device; and foreign substances can be prevented from intruding from the outside of the micro fluidic device in conjunction with the volume contraction in the micro fluidic device.

Embodiment 1

In the present exemplary embodiment, a method for real-time observation of an amplification product in a gene amplification process is described.

The method of the present embodiment uses the fluidic device illustrated in FIGS. 3A and 3B. In the present embodiment, a liquid containing target DNA is used as the fluid 12.

A ligase chain reaction is used for the amplification, and the liquid therefore contains DNA ligase and primer with the result that the ligase chain reaction is further promoted. The ligase chain reaction involves a ligation process and is accordingly mainly characterized by high specificity. Hence, the ligase chain reaction is used for detecting single base mutation in the gene.

The temperature-changing unit 14 serves for a DNA mutation process approximately at 95° C. and subsequently decreases the temperature to a range from 50° C. to 70° C. such that the DNA ligase used is most activated, and an annealing process and ligation process are then performed. In the present embodiment, for the sake of convenience, the description is made based on the assumption that the DNA ligase is most activated at 60° C.

Target DNA which does not mutate is amplified double after a single temperature cycle from 95° C. to 60° C. Thus, a DNA amplification product is increased in an exponential manner each time the temperature cycle is repeated.

In this case, it is assumed that the influence of the temperature-changing unit 14 on the fluid 12 is equal to the influence of the temperature-changing unit 15 on the fluid 12.

The temperature-changing unit 14 decreases temperature from 95° C. to 60° C. while the temperature-changing unit 15 increases temperature from 60° C. to 95° C. at a heating rate equal to the cooling rate by the temperature-changing unit 14, thereby amplifying target DNA while an amplification liquid remains in the reaction field 13. In the next temperature cycle, the first temperature-changing unit 14 serves for heating, and the second temperature-changing unit 15 serves for cooling, thereby enabling DNA amplification in the reaction field 13.

The situation of the amplification can be grasped as a result of measuring the fluorescence of an intercalating dye with an optical detector disposed above the reaction field 13. Since the transfer of a fluid due to temperature change is smaller than that in an existing technique, only the reaction field 13 and the vicinity thereof can be subjected to the measurement in the case of measuring the reaction field 13 with an area sensor. As a result, in addition to a measurement range being reduced, resolution of the measurement can be improved.

In the case where three temperature-changing units are provided in the reaction field 13, the heating or cooling of the central temperature-changing unit is in opposite phase to the heating or cooling of the other two temperature-changing units. In addition, the volume of a fluid is thermally expanded in a degree the same as that of the thermal contraction of the volume of the fluid, thereby being able to observe a reaction while the fluid remains in the reaction field 13. In particular, the central temperature-changing unit decreases temperature from 95° C. to 60° C. while the other two temperature-changing units increase temperature from 60° C. to 95° C. Alternatively, the central temperature-changing unit increases temperature from 60° C. to 95° C. while the other two temperature-changing units decrease temperature from 95° C. to 60° C.

In the technique for controlling a fluid in the present embodiment, the thermal expansion or evaporation of a fluid can be prevented from causing the transfer of the fluid, and PCR temperature cycles having different phases can be individually applied to two portions in one PCR region. The method of the present embodiment can be applied to a two-step PCR temperature cycle in which an annealing process and an extension process are performed at the same temperature. In this case, the annealing and extension processes are performed at 65° C., and the denaturing process is performed at 95° C. Temperature is increased from 65° C. to 95° C. at a rate the same as that in temperature decrease from 95° C. to 65° C., so that the expansion of a fluid in one temperature-changing region with the temperature-changing unit is canceled by the contraction of a fluid in the other temperature-changing region. The position of the fluid can be consequently prevented from being changed.

A reaction may be promoted by only two temperature-changing units, and the position of the fluid can be prevented from being changed.

Embodiment 2

In another exemplary embodiment, a method is described where temperature in a micro channel is decreased to suppress the external intrusion of foreign substances.

Figure 4:
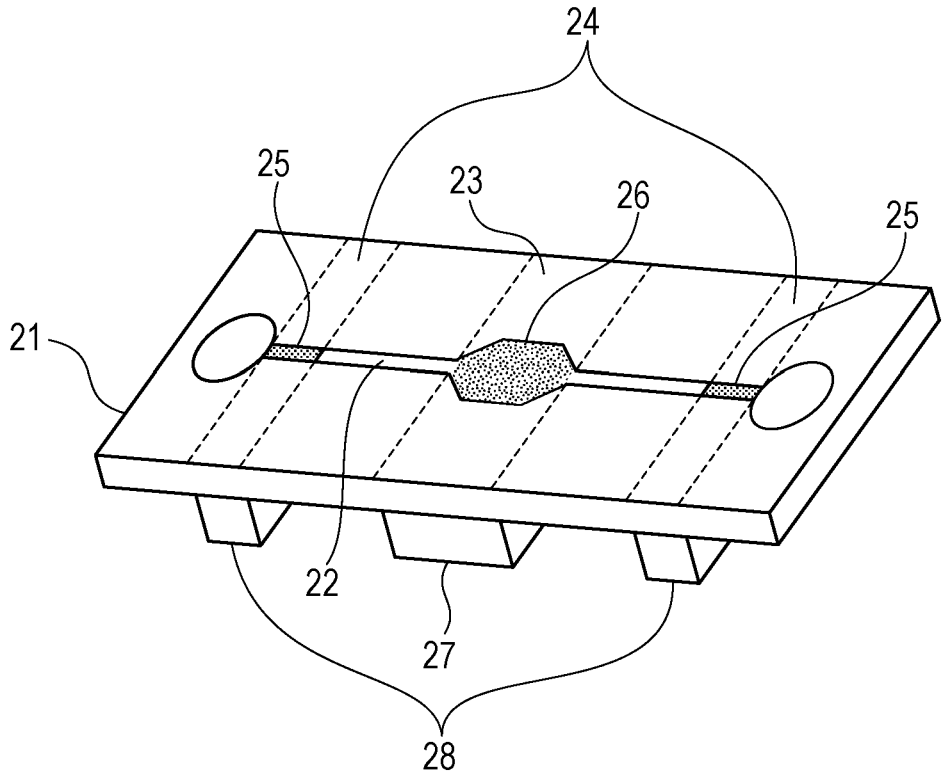
FIG. 4 schematically illustrates an embodiment of the invention.

With reference to FIG. 4, a micro channel 22 is formed in a micro fluidic device 21. Temperature changes are caused in regions 23 and 24 by temperature-changing units 27 and 28, respectively. In the micro channel 22, a fluid 25 is positioned in a region 24, and a fluid 26 is positioned in a region 23.

A DNA probe is disposed in the fluid 26 and is hybridized with a suspended DNA fragment. Although hybridization is conducted in various temperature environments, for example, from 35° C. to 60° C., a reaction may be promoted at a constant temperature. However, DNA is denatured at approximately 90° C. in a front-end process, and acute temperature change occurs, for instance, from approximately 90° C. to 42° C. In this case, the fluid 26 is cooled in a short time and is therefore subjected to volume contraction. The volume of the entire fluid in the micro channel 22 is accordingly decreased, and foreign substances outside the micro fluidic device 21 may intrude into the micro channel 22 to influence on the measurement results.

In order to prevent the intrusion, the fluid 25 at the ends of the micro channel 22 is thermally expanded so that the volume of the fluid can be maintained constant in the micro channel 22. In particular, the temperature-changing unit 27 cools the fluid 26 while the temperature-changing unit 28 heats the fluid 25. The volume is thermally contracted in a degree the same as that of the thermal volume expansion, thereby being able to maintain the volume of the fluid constant in the micro channel 21. Alternatively, the volume of the fluid 26 is contracted in a degree larger than that of the volume expansion of the fluid 25, thereby being able to prevent the intrusion of foreign substances from the outside of the micro fluidic device 21.

Embodiment 3

In another exemplary embodiment, a method is described where a fluid in a micro channel is heated to prevent the fluid from being ejected from a micro fluidic device.

The micro fluidic device 21 illustrated in FIG. 4 is used for Loop-mediated Isothermal Amplification (LAMP) as isothermal gene amplification. With the aid of strand displacing DNA polymerase, the dosage of a gene that has been amplified by the temperature-changing unit 27 at a constant temperature ranging from 60° C. to 65° C. for approximately an hour is, for example, increased approximately $10^{10}$ times larger than the gene dosage before the amplification. In this case, the amplification can be confirmed by clouding of the fluid 26.

DNA polymerase needs to be deactivated to terminate the amplification, and a deactivation process involves continuous heating from several minutes to several tens of minutes at a temperature approximately ranging from 80° C. to 95° C. with the temperature-changing unit 27. In the case where the temperature of the fluid in the micro fluid 22 is quickly increased approximately by 20° C. to 35° C., the fluid which contains a gene highly amplified by thermal expansion flies to the outside of the micro fluidic device with the result that measurement environment may be contaminated.

In order to prevent ejection, the temperature-changing unit 28 contracts the fluid 25 in a degree equal to that of the volume expansion of the fluid 26, thereby being able to maintain the volume of a fluid constant in the micro channel 22.

Embodiment 4

In still yet another exemplary embodiment, a thermal treatment method for disposal of a micro fluidic device after cell culture and an enzyme reaction is described.

Tools, such as a Petri dish, after cell culture are disinfected by using an autoclave and then discarded. In the case where an autoclave is used for the micro fluidic device, it is difficult to ensure that the treatment provided by the autoclave has effectively treated the inside of the micro channel.

In the case where cell culture or an enzyme reaction is performed in the micro fluidic device 21, the micro fluidic device 21 should be discarded in a state in which cell activity and enzyme activity are completely terminated. It is assumed that the micro fluidic device 21 illustrated in FIG. 4 contains the fluid 26 containing cells and a culture solution and that intended cellular measurement has finished. In this case, the temperature-changing unit 27 increases temperature approximately from 120° C. to 150° C. so that cells can be terminated and enzyme inside the cells can be completely deactivated.

Ejection from the micro fluidic device of the terminated cells and deactivated enzyme should be avoided, as it is desirable that they be left inside the micro fluidic device. The temperature-changing unit 27 increases temperature while the temperature-changing unit 28 decreases temperature, and the volume of the fluid 25 is contracted in a degree larger than that of the volume expansion of the fluid 26, thereby being able to perform thermal treatment without ejection of a cell fragment and enzyme from the micro fluidic device 21. At this time, since the temperature-changing unit 27 increases temperature to a range approximately from 120° C. to 150° C., the temperature-changing unit 28 may need to decrease temperature below room temperature. A Peltier device can be employed as the temperature-changing unit.

A resistive heating element provided on the channel wall can be also used as a temperature-measuring portion, and temperature in the channel can be measured from its resistance. The measurement results are monitored so that temperature can be further accurately controlled.

The above-described embodiments can be applied to micro fluidic devices used for chemical synthesis, environmental analysis, and analysis of clinical specimens involving a heating or cooling process.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-109450 filed May 16, 2011, which is hereby incorporated by reference herein in its entirety.

What is claimed is:

1. A thermal treatment apparatus comprising:

a fluidic device having at least one channel;

a first temperature-changing unit configured to change a temperature of a fluid in at least a first part of the at least one channel;

a second temperature-changing unit configured to change a temperature of the fluid in at least a second part of the at least one channel; and a microprocessor configured to instruct the first and second temperature-changing units, wherein the microprocessor includes a mode of instructing the first and second temperature-changing units to change their respective temperatures opposite to each other while the fluid remains in a reaction field in the at least one channel, wherein the temperature changes by the first and second temperature-changing units cause at least any one of an expansion and contraction of the fluid in parts of the channel that are affected by the temperatures changes, and wherein the at least any one of the expansion and contraction of the fluid due to the temperature change caused by the first temperature-changing unit is offset by the at least any one of the expansion and contraction of the fluid due to the temperature change caused by the second temperature-changing unit.

2. The thermal treatment apparatus according to claim 1, wherein the microprocessor instructs the first and second temperature-changing units to change their respective temperatures by having the first temperature-changing unit increase temperature at a rate equal to a rate the second temperature-changing unit decreases temperature or by having the first temperature-changing unit decrease temperature at a rate equal to a rate the second temperature-changing unit increases temperature.

3. The thermal treatment apparatus according to claim 1, wherein PCR is performed in parts of the channel where the first temperature-changing unit and the second temperature-changing unit increase temperature.

4. The thermal treatment apparatus according to claim 1, wherein the first and second temperature-changing units are Peltier devices.

5. The thermal treatment apparatus according to claim 1, wherein the first and second temperature-changing units include a cooler that externally cools a resistive heating element and the fluidic device, wherein the resistive heating element is located in the channel.

6. An analysis system comprising:

a fluidic device having at least one channel;

a first temperature-changing unit configured to change a temperature of a fluid in at least a first part of the at least one channel;

a second temperature-changing unit configured to change a temperature of the fluid in at least a second part of the at least one channel;

a microprocessor configured to instruct the first and second temperature-changing units, wherein the microprocessor includes a mode of instructing the first and second temperature-changing units to change their respective temperature opposite to each other while the fluid remains in a reaction field in the at least one channel; and an optical detector configured to detect light emission from the channel, wherein the temperature changes by the first and second temperature-changing units cause at least any one of an expansion and contraction of the fluid in parts of the channel that are affected by the temperatures changes, and wherein the at least any one of the expansion and contraction of the fluid due to the temperature change caused by the first temperature-changing unit is offset by the at least any one of the expansion and contraction of the fluid due to the temperature change caused by the second temperature-changing unit.

7. A method for treating a fluid by using a thermal treatment apparatus of claim 1 having at least one channel, the method comprising:

changing a temperature in at least a first part of the channel; and changing a temperature in at least a second part of the channel, wherein the fluid remains in a reaction field in the at least one channel while the temperature in the at least first part of the channel and in the at least second part of the channel are changed opposite to each other, wherein the temperature changes causes at least any one of an expansion and contraction of the fluid in a part of the channel affected by the temperature changes, and wherein the at least any one of the expansion and contraction due to temperature change in the at least first part is offset by the at least any one of the expansion or contraction due to temperature change in the at least second part.

8. The method for treating a fluid according to claim 7, wherein a rate of temperature increase in part of the channel is equal to a rate of temperature decrease in another part of the channel.

* * * * *